US008899640B2

(12) United States Patent
Bertolotti Potachin

(10) Patent No.: US 8,899,640 B2
(45) Date of Patent: Dec. 2, 2014

(54) VEHICLE DOOR SAFETY LOCK HANDLE ASSEMBLY

(75) Inventor: Angelo Bertolotti Potachin, Turin (IT)

(73) Assignee: Illinois Tool Works Inc., Glenview, IL (US)

( * ) Notice: Subject to any disclaimer, the term of this patent is extended or adjusted under 35 U.S.C. 154(b) by 423 days.

(21) Appl. No.: 13/110,355

(22) Filed: May 18, 2011

(65) Prior Publication Data

US 2011/0285150 A1 Nov. 24, 2011

(30) Foreign Application Priority Data

May 19, 2010 (IT) ..... TO2010A0416

(51) Int. Cl.

| | |
|---|---|
| ***E05B 3/00*** | (2006.01) |
| ***E05B 77/06*** | (2014.01) |
| ***E05B 79/20*** | (2014.01) |
| *E05B 65/10* | (2006.01) |
| *E05B 85/16* | (2014.01) |

(52) U.S. Cl.

CPC ..... *E05B 77/06* (2013.01); *E05B 85/16* (2013.01); *E05B 79/20* (2013.01); *Y10S 292/22* (2013.01)

USPC ..... 292/336.3; 292/DIG. 22

(58) Field of Classification Search

CPC ..... E05B 85/10; E05B 85/12; E05B 85/16; E05B 77/06; E05B 77/02; E05B 77/04

USPC ..... 292/336.3, DIG. 22

See application file for complete search history.

(56) References Cited

U.S. PATENT DOCUMENTS

| | | | | |
|---|---|---|---|---|
| 3,719,248 | A * | 3/1973 | Breitschwerdt et al. | 180/271 |
| 4,616,862 | A * | 10/1986 | Ward | 292/201 |
| 4,889,373 | A * | 12/1989 | Ward et al. | 292/336.3 |
| 5,681,068 | A * | 10/1997 | Kleefeldt et al. | 292/336.3 |
| 6,007,122 | A | 12/1999 | Linder et al. | |
| 6,062,615 | A * | 5/2000 | Hunt et al. | 292/336.3 |
| 6,382,688 | B1 * | 5/2002 | Agostini | 292/336.3 |

(Continued)

FOREIGN PATENT DOCUMENTS

| | | | |
|---|---|---|---|
| DE | 2023859 | A1 | 11/1971 |
| DE | 19610200 | A1 | 9/1997 |

(Continued)

OTHER PUBLICATIONS

Italian Search Report for IT TO2010A000416 dated Jan. 17, 2011.

*Primary Examiner* — Carlos Lugo

(74) *Attorney, Agent, or Firm* — Lowe Hauptman & Ham LLP

(57) ABSTRACT

A handle assembly includes a support fixable to the door of a vehicle, a grip carried by the support tilting between a rest position and a working position, in which it is at least partially turned transversally with respect to the support, and a mechanical motion transmission device connecting in use the grip to a door locking device for releasing the latter when the grip is in the working position. The handle assembly further includes a counter-weight carried by in the support transversally movable to the same between a first position, in which it is arranged facing, but away from the mechanical motion transmission device, and a second position, in which it intercepts the motion transmission device for stopping the same along at least part of their movement path thus preventing the release of the door locking device.

25 Claims, 4 Drawing Sheets

(56) References Cited

U.S. PATENT DOCUMENTS

| | | | | |
|---|---|---|---|---|
| 6,808,214 | B2 * | 10/2004 | Sato et al. | 292/341.15 |
| 6,929,294 | B2 * | 8/2005 | Byrla et al. | 292/336.3 |
| 7,303,217 | B2 * | 12/2007 | Savant | 292/336.3 |
| 7,635,151 | B2 * | 12/2009 | Rodawold et al. | 292/336.3 |

FOREIGN PATENT DOCUMENTS

| | | | |
|---|---|---|---|
| DE | 102005049142 | A1 | 4/2007 |
| DE | 102005049144 | A1 | 4/2007 |
| DE | 102008032324 | A1 | 1/2010 |
| DE | 202008012949 | U1 | 4/2010 |

* cited by examiner

VEHICLE DOOR SAFETY LOCK HANDLE ASSEMBLY

RELATED APPLICATIONS

The present application is based on, and claims priority from, Italian Application Number TO2010A000416, filed May 19, 2010, the disclosure of which is hereby incorporated by reference herein in its entirety.

The present invention relates to a handle assembly for a vehicle door provided with a safety locking system of the handle assembly grip adapted to promptly prevent the accidental release of the door locking means, e.g. consisting of a lock, in case of side crash of the vehicle.

A handle assembly for a vehicle door provided with a safety device which prevents the inertial forces developing during a side crash from opening the door is known, for example from EP 1950366; such a phenomenon occurs in handle assemblies provided with a tilting grip, in which the user, in order to open the door, makes the grip rotate with respect to a support of the same restrained to the door, so as to move one end of the handle away from the support; such an end is normally associated to a control arm, which is operatively associated to a rotating body carried by the support and connected to a bowden cable, in turn rotationally connected to various door locking means constituted by the lock itself. By manually rotating the handle, the user tightens the bowden cable and produces the unlocking of the lock. In case of a side crash to the vehicle, however, the grip may be rotated by the inertial forces, thus releasing the lock and causing the opening of the door, with severe danger for the passengers.

In order to avoid this drawback, in the handle assembly according to EP 1950366, the grip is normally disconnected from the rotating body and integrally provided with a safety lever carried on the back of the grip so as to be pressed by the user during the manual rotation of the grip; the safety lever controls a hooking lever, which only at this point, i.e. with the safety lever manually pressed, connects the grip to the rotating body, thus allowing the manual release of the door locking means, but not the accidental release thereof caused by a side crash.

The described handle assembly is however relatively complex and costly to make, and may experience operating difficulties during manual opening. Furthermore, the safety lever may be subjected to transversal accelerations in case of crash which may thus produce the accidental movement.

Other handle assemblies are known, for example from U.S. Pat. No. 3,967,844, FR290844 and US2007/0091680, in which a locking system of the rotary motion of the grip is contemplated, which is only disengaged when the user grasps the grip to open the door, instead. These systems however have a complex, relatively bulky construction and, if the locking system is based on a side ratchet which slides transversally to the rotation plane of the grip, seizing or operating difficulty may occur, particularly at low temperatures.

It is an object of the present invention to overcome the drawbacks of the prior art by providing a handle assembly for a vehicle door which is of simple construction, which is reliable, compact and relatively cost-effective to make, and which, at the same time, effectively prevents the opening of the door in case of side crashes of the vehicle.

The present invention thus relates to a handle assembly for a vehicle door, as disclosed in claim 1.

In particular, the vehicle door handle assembly comprises a support fixable to the door, a grip carried by the support rotating between a rest position, in which it is substantially adjacent to the support, and a working position, in which it is at least partially away from the support, and mechanical motion transmission means connecting in use the grip to door locking means for releasing the latter when the grip is turned to the working position.

According to the main aspect of the invention, the handle assembly further comprises a counter-weight of predetermined mass carried by the support transversally movable to the rotation axis of the grip between a first position, in which it is arranged facing, but away from the mechanical motion transmission means, and a second position in which it intercepts the motion transmission means for stopping them along at least part of their movement path, thus preventing the release of the door locking means.

In particular, the counter-weight is adapted to take the second position upon applying an acceleration to the handle assembly, which is transversally directed to the rotation axis of the grip and of an amount such as to stress the grip to move towards the working position due to the inertial effect.

In this manner, the counter-weight, which is advantageously made so as to have a mass higher than that of the grip, is stressed in use by the same transversal acceleration that may eventually stress in use the grip of the vehicle door handle assembly in case of side crash of the vehicle and consequently moves by inertial stress, transversally both with respect to the support and to the rotation axis of the grip, before the grip, again due to the inertial effect, can perform any rotation of direction and amount such to produce the opening of the door. Once triggered, the movement of the counter-weight, which precedes the one of the grip, locks the motion transmission means, thus avoiding in simple and effective manner the accidental opening of the door.

Furthermore, very advantageously a safety mechanism such as that constituted by the mentioned counter-weight, when it is not actuated by a transversal inertial stress, does not minimally affect the operation of the handle assembly, which thus cannot be in use subjected to jamming caused by the safety mechanism itself. Furthermore, it is very compact in size and may easily be accommodated in the normally available voids in the support, so as to obtain a handle assembly which is absolutely safe but also of dimensions essentially equal to those of a handle assembly free from safety systems.

Furthermore, the entire assembly is very simple to make and assemble.

Further features and advantages of the present invention will be apparent from the following description of two preferred embodiments thereof, exclusively provided by way of non-limitative example, with reference to the accompanying drawings, in which.

Figure 1:
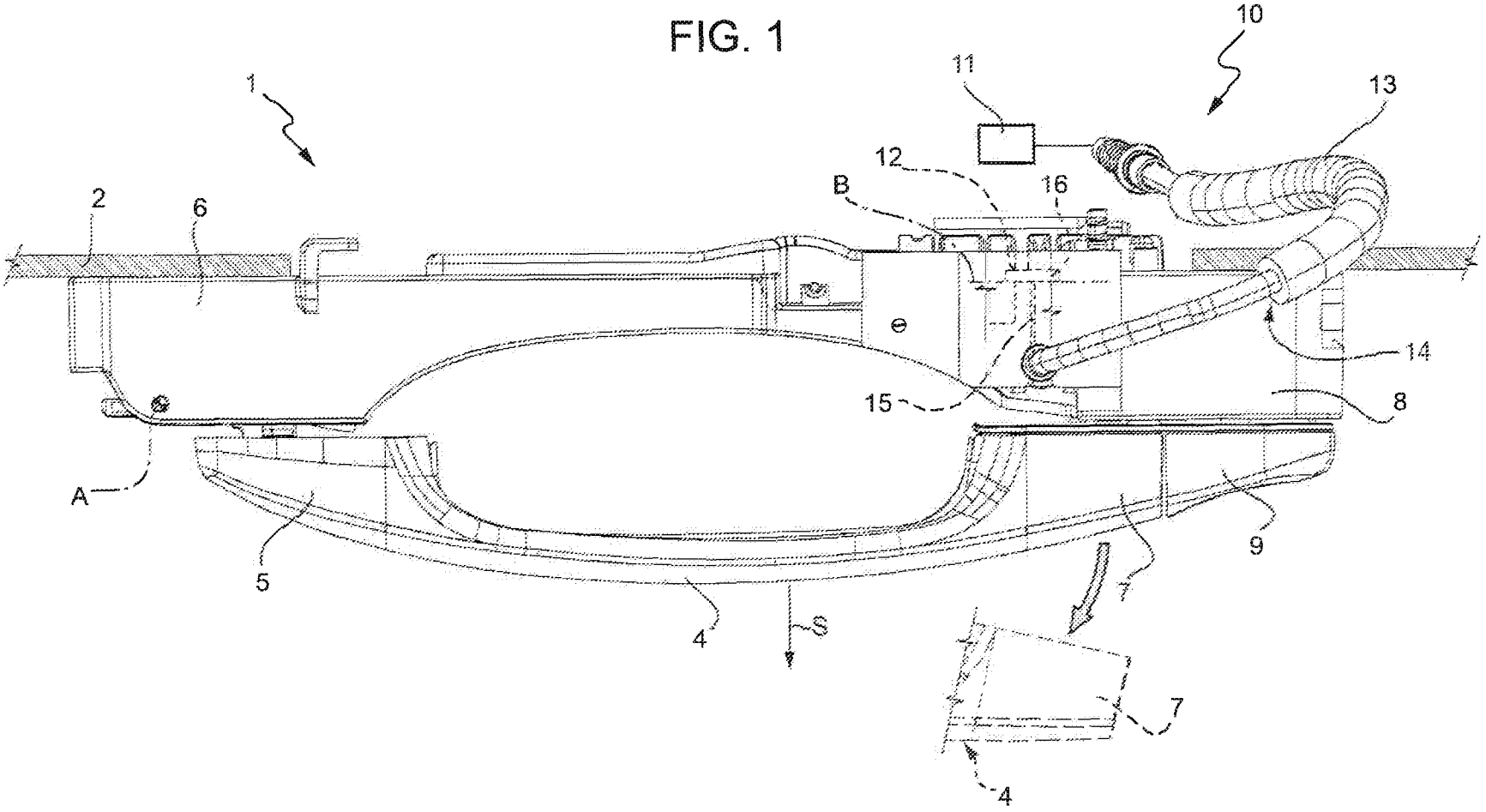
FIG. 1 shows a top plan of a handle assembly for a vehicle door made according to the invention.
Figure 2:
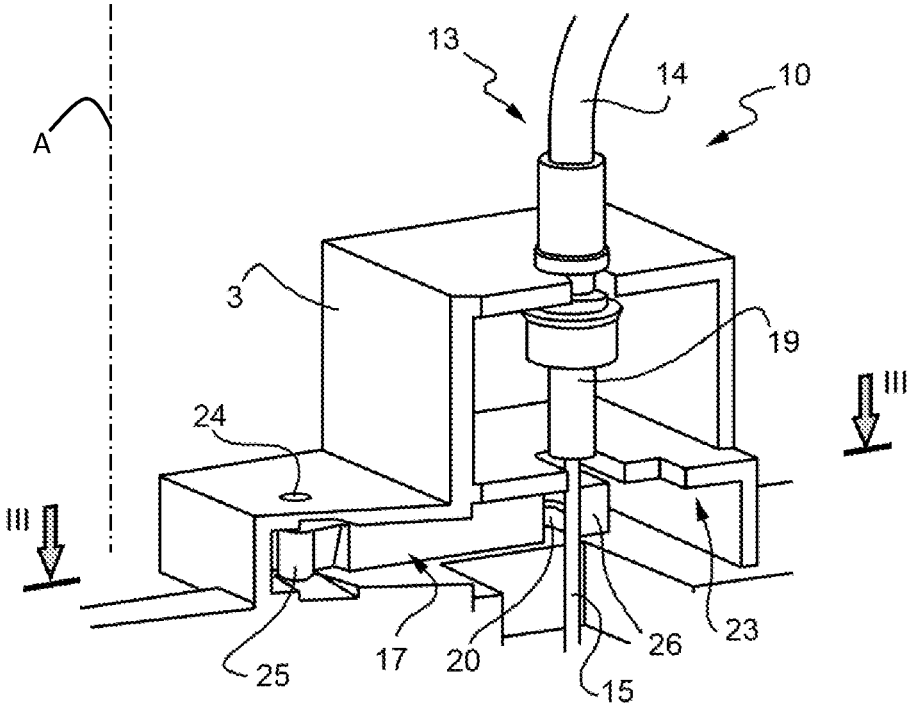
FIG. 2 shows a detail in enlarged scale and three-quarters rear axonometric view of the handle assembly in FIG. 1, in a first configuration of use.
Figure 3:
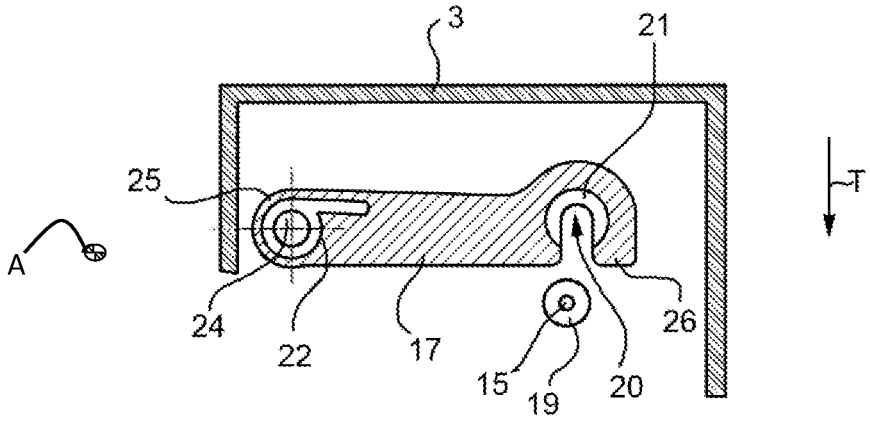
Figure 4:
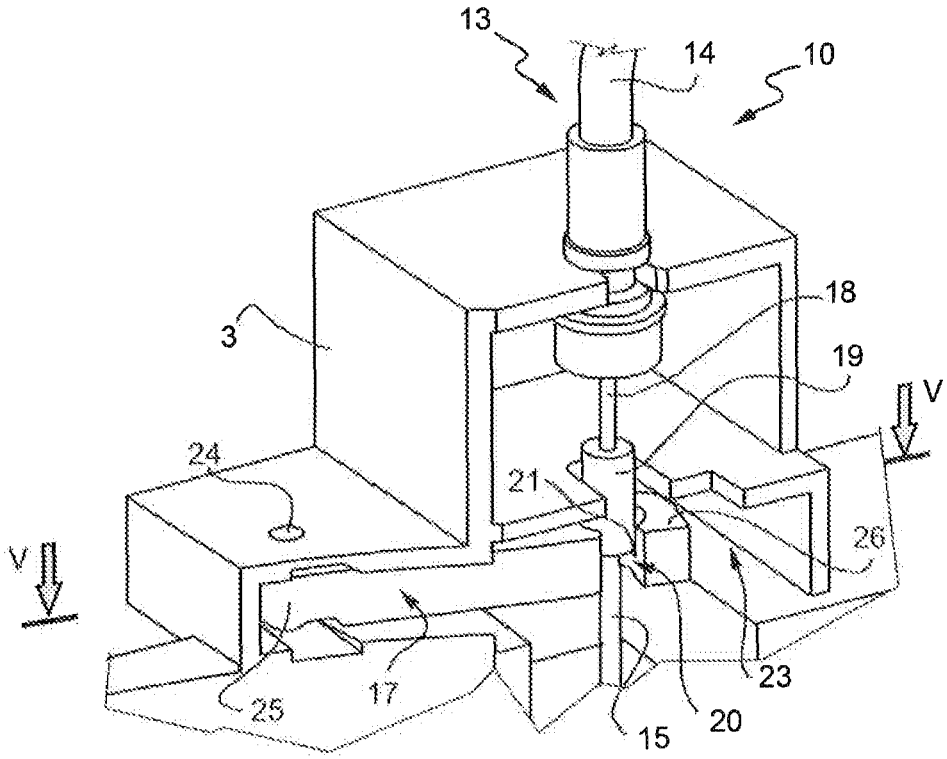
Figure 5:
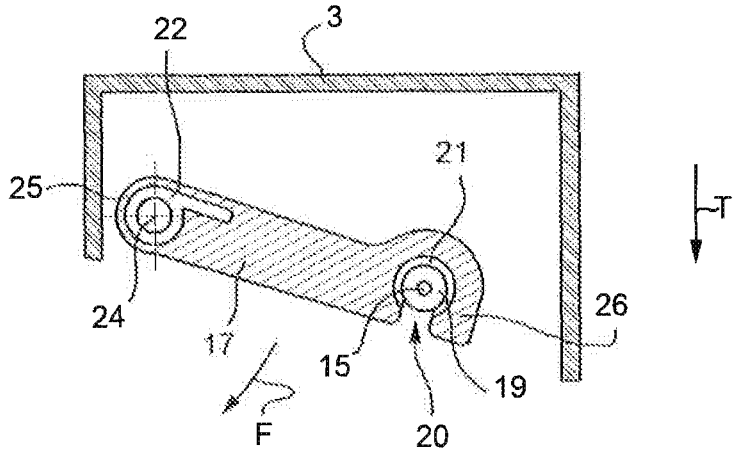
Figure 6:
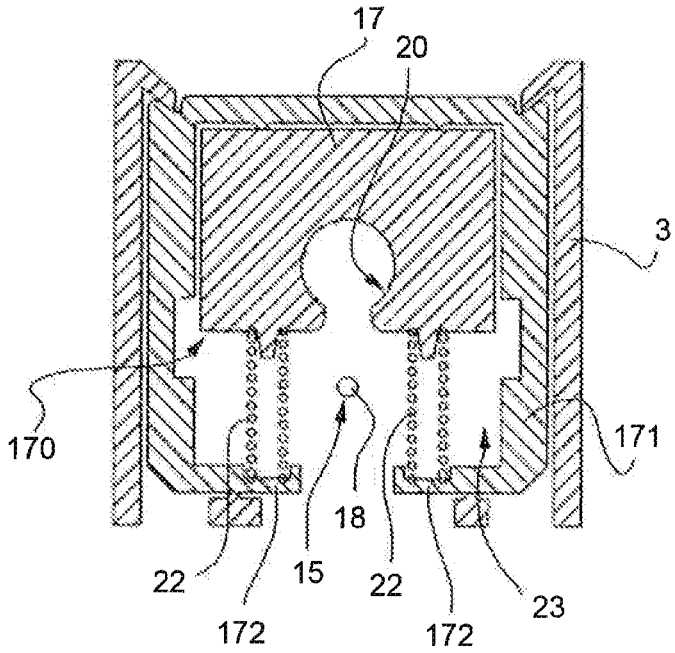

FIG. 3 diagrammatically shows a section view according to a plotting plane III-III of the detail in FIG. 2 of the handle assembly according to the invention with parts removed for simplicity;

FIG. 4 shows the same detail of FIG. 2 of the handle assembly of FIG. 1 in a second configuration of use;

FIG. 5 diagrammatically shows a section view according to a plotting plane V-V of the detail in FIG. 4 of the handle assembly according to the invention with parts removed for simplicity; and FIG. 6 shows in enlarged scale the same detail of FIGS. 3 and 5 but made according to a possible variant of the handle assembly according to the invention.

With reference to figures from 1 to 5, numeral 2 indicates as a whole a door 2 for a vehicle, known and not shown.

The handle assembly 1 comprises a support 3 fixable to the door 2 and a grip 4 carried by the support 3 rotating about an axis A between a rest position, illustrated with a solid line in FIG. 1, in which the grip 4 is arranged substantially adjacent to the support 3, and a working position, shown only in part with a dashed line, in which the grip 4 is arranged at least partially away from the support 3.

In particular, the grip 4 has first end 5 hinged in known manner to a corresponding end 6 of the support 3 about axis A, which in use is normally arranged substantially vertical so that the rotation movement of the grip 4 occurs in use on a substantially horizontal plane. Obviously, if needed, the same group 1 could be mounted with axis A arranged substantially horizontal (so that the motion of the grip 4 occurs on a substantially vertical plane arranged transversally to the direction of movement of the vehicle) without any of the following description being affected.

Conversely, an opposite end 7 of the grip 4 is arranged adjacent in the mentioned rest position to a corresponding end 8 of the support 3, end 8 which also carries a housing 9 for a key catch (known and not shown for the sake of simplicity). The end 7, in the working position of the grip 4, shown with a dashed line in FIG. 1, is arranged away from the support 3, in particular from the end 8 thereof, turned by a given angle, e.g. 30°, about axis A, with respect to the rest position. The grip 4 is adapted to take such a position by effect of a manual traction S (FIG. 1) exerted by a user who grasps the grip 4 to cause the opening of the door 2.

The handle group 1 further comprises mechanical transmission means 10 of the motion connecting in use, in manner known as a whole, the grip 4 with the door locking means 11, known and diagrammatically shown by a block, for releasing the latter when the grip 4 is turned to the working position with the end 7 arranged distanced from the end 8 of the support 3 transversally to the direction of extension by length of the same, which goes from the end 6 to the end 8.

The motion transmission means 10 generally comprise an arm (known and not shown) integrally carried by the end 7 of the grip 4 so as to overhangingly extend from the same, towards and through the support 3, and a drum 12 (illustrated with a dashed line in FIG. 1) carried in known manner by the rotational support 3 about an axis B perpendicular to rotational axis A of the grip 4 and operatively associated to the mentioned arm integral with the end 7 so that the drum 12 is adapted to be selectively turned in the opposite direction by the movement of the grip 4 between the rest position and the working position, and vice versa.

The motion transmission means 10 further comprises a bowden cable 13 operatively associated to the drum 12, comprising (FIGS. 2 and 4) an external tubular sheath 14 anchored in known manner to the support 3 and an internal cable 15 axially sliding in the sheath 13 and which ends with a first axial shoulder element 16, known, by means of which the internal cable 15 is, in use, gradually made to translate with respect to the support 3 and the sheath 14 by the rotation of the grip 4 towards the working position, in the case in point in an indirect way by means of the drum 12, which is directly actuated in rotation by the grip 4 by means of the mentioned arm (known and not shown) and to which the internal cable 15 of the bowden cable 13 is tangentially anchored, in known manner, by means of the first axial shoulder element 16. In an exemplary embodiment, there is a means for transmitting the movement of a door handle grip to a door lock so as to unlock the door upon application of a force to the grip, comprising elements 12-16 and 18.

According to the invention, the handle assembly 1 further comprises a counter-weight 17 of predetermined mass carried by the support 3 transversally movable to the rotation axis A of the grip 4 between a first position, shown in FIGS. 2 and 3, in which the counter-weight 17 is arranged facing, but away from the mechanical motion transmission means 10 or part thereof, and a second position, shown in FIGS. 4 and 5, in which the counter-weight 17 intercepts the motion transmission means 10 or parts thereof for stopping them along at least part of their movement path (path identified by the axial/longitudinal translation of the cable 15 which is inferred by comparing FIGS. 2 and 4; thus preventing the release of the door locking means 11.

In particular, the counter-weight is adapted to take the second position, shown in FIGS. 4 and 5, upon applying an acceleration T to the handle 1, which is transversally directed to the rotation axis of the grip 4 and of an amount such as to stress the grip 4 to move towards the working position due to an inertial effect.

According to the illustrated embodiment, the interception of the mechanical transmission means 10 by the counter-weight 17 is carried out with reference to the internal cable 15 of the bowden cable 13.

Indeed, according to a non-secondary aspect of the invention, the internal cable 15 is provided, in combination with the shoulder element 16 and at a segment thereof 18 free from the outer sheath 14 and accommodated in use within the support 3, with a second axial shoulder element 19 which, when the grip 4 is in the rest position, is arranged immediately upstream of the counter-weight 17 (FIG. 2) with reference to the direction of translation of the internal cable 15, and which is adapted to be intercepted by the counter-weight 17, when this is in the second position (FIGS. 4 and 5) as soon as the grip 4 leaves its rest position for turning towards the working position.

Indeed, according to the description above, whenever for any reason the grip 4 leaves the rest position, it turns the drum 12 and translates the internal cable 15 in direction of the drum 12, which "pulls" it by means of the shoulder element 16. Consequently, when the counter-weight 17 is in the second position in FIGS. 4 and 5 and intercepts the second shoulder element 19, according to the invention it locks both the rotation of grip 4 and the translation of the internal cable 15.

For this purpose, according to an aspect of the invention, the counter-weight 17 is arranged facing the stretch 18 free from sheath of the internal cable 15 of the bowden cable 13 and is carried by the support 3 so as to move between the first and second positions only in a controlled manner, in particular on a plane substantially arranged perpendicularly to the axis of the stretch 13 free from sheath of the internal cable 15. Preferably, the stretch 18 of the cable 15 is arranged parallel to the rotation axis A of the grip 4.

In order to easily intercept the shoulder element 19, which is defined for example by a cylindrical element integrally restrained to the stretch 18 of the cable 15, the counter-weight 17 is thoroughly provided in the direction of extension of the cable 15 with a seat 20 shaped so as to be adapted to receive in use the second axial shoulder element 19 of the internal cable 15 of the bowden cable 13 therein; in particular, the seat 20 is obtained so as to be arranged parallel and facing the stretch 18 of the internal cable 15 free from sheath when the counter-weight 17 is in the first position (FIG. 3) and substantially coaxial to the stretch 18 when the counter-weight 17 is in the second position of FIGS. 4 and 5.

In particular, the seat 20 is C-opened towards the stretch 18 free from sheath of the internal cable 15 and is provided with shoulder means 21, defined in the case in point by an end edge, in relief, of the seat 20, against which the second shoulder element 19 abuts in use, when the counter-weight 17 is in the second position, thus axially anchoring the internal cable 15 of the bowden cable 13 to the counter-weight 17 itself.

According to a further aspect of the invention, the counter-weight 17 is operatively associated with elastic means 22, diagrammatically illustrated in FIGS. 3 and 5, which, being preloaded, normally keep the counter-weight 7 in the first position (FIG. 3) and elastically contrast the movement of the counter-weight 17 towards the second position, in essence opposing in use the inertial stress caused to the counter-weight 17 by the acceleration T.

According to the invention, the stiffness of the elastic means 22 and the mass of the counter-weight 17 are chosen so that, in use, the amount of the inertial force F is such to prevail on the contrast force exerted by the elastic means 22 whenever the acceleration T transversal to the rotation axis A of the grip 4 to which the vehicle, which carries the handle assembly 1, is subjected so as to generate on the grip 4 an inertial force sufficient to move the grip from the rest position in FIG. 1 to the working position, e.g. against the bias of elastic recalling means of the grip 4 (known and not shown).

Thus, in general, the counter-weight 17 has a greater mass than the grip 4, e.g. being preferably made of a metallic alloy, e.g. ZAMA, while the grip 4 is preferably made of a synthetic plastic material.

According to the embodiment shown in FIGS. 2-5, the counter-weight 17 is shaped as a lever longitudinally extending in the direction of the longitudinal extension of the support 3, which is accommodated in the above mentioned counter-weight first position 17 within a seat 23 of the support 3, which is hinged to the support 3 parallel to the rotation axis A of the grip 4.

In particular, the counter-weight 17 is shaped as a lever rotatingly restrained to the support 3 by means of a pin 24 at a first end 25 thereof, and provided with the seat 20 at a second end 26 thereof, opposite to the end 25 and arranged facing the mechanical motion transmission means 10, in the case in point the stretch 18 of the cable 15, so as to be adapted to intercept them in the second position of the counter-weight 17.

Consequently, the inertial force F which is generated in use on the counter-weight 17 by the acceleration T is a torque adapted to make the counter-weight 17 turn on the pin 24 and against the bias of the elastic means 22 so as to move the end 26 between a retracted position in the seat 23 (FIGS. 2,3) and an extracted position from the seat 23, in which the end 26 overhanging protrudes towards the grip 4 to engage with the seat 20 the stretch 18 of the cable 15.

FIG. 6 shows a possible variant of the handle assembly 1, in which details either similar or equal to those already described are indicated for the sake of simplicity with the same numbers. In particular, the variant consists in a different embodiment of the counter-weight 17. This is, in the case in point, shaped as a slide 170 slidingly carried by the support 3 by means of a guiding element 171 in a direction substantially perpendicular to the rotation axis A of the grip 4 within a seat 23 arranged facing the mechanical motion transmission means 10.

In particular, the seat 23 is open towards the cable 15, which crosses it with the stretch 18, and the elastic means 22 consist in spiral springs arranged sandwiched between the slide 170 and shoulder elements 172 of the guide elements 171. In the middle, the slide 170 is provided with seat 20 adapted to intercept and couple the shoulder element 19 in use.

In use, when a transversal acceleration T of high intensity (e.g. in the case of side crash of the vehicle) is applied to the handle assembly 1, it acts more rapidly on the counter-weight 17 than on the grip 4. Thus, the counter-weight 17 goes to extracted position (second position) and when the grip 4 starts to move from the rest position making the cable 15 slide, the counter-weight 17 intercepts the shoulder element 19, locking the sliding/translation of the cable 15 and also the movement of the grip 4. The door of the vehicle thus remains locked in the closing position as the locking means 11 are not released, the minimum sliding movement to which the cable 15 was subjected being insufficient for this purpose.

Conversely, if there is no applied acceleration T, the counter-weight 17 remains in the seat 23, locked therein by the elastic means 22, and the handle assembly 1 normally works as if the counter-weight 17 were not present, allowing the grip 4 to release the means 11 whenever the user applies a force S thereto.

The invention claimed is:

1. A vehicle door handle assembly comprising a support fixable to a door, a grip carried by the support rotating between a rest position, in which it is substantially adjacent to the support, and a working position in which it is at least partially away from the support, and mechanical motion transmission means connecting in use the grip to a door locking means for releasing the latter when the grip is turned to the working position; characterized in that it further comprises a counter-weight of predetermined mass carried by the support transversally movable to a rotation axis of the grip between a first position, in which it is arranged facing, but away from the mechanical motion transmission means, and a second position in which it intercepts the motion transmission means for stopping them along at least part of their movement path thus preventing the release of the door locking means; the counter-weight being adapted to take the second position upon applying an acceleration to the handle, which is transversally directed to the rotation axis of the grip and of an amount such as to stress the grip to move towards the working position due to an inertial effect.

2. The handle assembly according to claim 1, wherein the motion transmission means comprise a bowden cable comprising an external tubular sheath anchored to the support and an internal cable axially sliding within the sheath and ending with a first axial shoulder element, wherein the internal cable is gradually translated with respect to the support and to the sheath by the rotation of the grip towards the working position and the internal cable is provided with a second axial shoulder element at a stretch thereof and free from the external sheath and accommodated within the support; and wherein the second axial shoulder element is arranged immediately upstream of the counter-weight when the grip in the rest position, with reference to the translation direction of the internal cable, and configured to be intercepted by the counter-weight, when this is in the second position, as soon as the grip leaves the rest position to rotate towards the working position in the second position, thereby blocking both the rotation of the grip and the translation of the internal cable.

3. The handle assembly according to claim 2, wherein the internal cable of the bowden cable is connected to the grip by a drum carried by the support pivoting about an axis perpendicular to the rotation axis of the grip and the first axial shoulder element is tangentially anchored, and wherein the drum is selectively rotated in the opposite direction by the movement of the grip between the rest position and the working position.

4. The handle assembly according to claim 2, wherein the counter-weight is arranged facing the stretch free from sheath of the internal cable of the bowden cable and is carried by the support to move between the first position and second position on a plane substantially arranged perpendicularly to the axis of the stretch free from sheath of the internal cable.

5. The handle assembly according to claim 4, wherein the counter-weight is thoroughly provided with a seat configured to receive a second axial shoulder element of the internal cable of the bowden cable therein, wherein the seat is obtained to be arranged parallel to the stretch free from sheath of the internal cable in the first position of the counter-weight and substantially coaxial to the stretch free from sheath of the internal cable in the second position of the counter-weight, and wherein the seat is C-opened towards the stretch free from sheath of the internal cable and is provided with shoulder means against the second shoulder element abuts in use, when the counter-weight is in the second position, thereby axially anchoring the internal cable of the bowden cable to the counter-weight.

6. The handle assembly according to claim 1, wherein the counter-weight is operatively associated with elastic means for keeping the counter-weight in the first position and elastically contrast the movement of the counter-weight towards the second position, wherein a stiffness of the elastic means and a weight of the counter-weight is chosen so that the inertial force generated on the counter-weight by an acceleration transversal to the rotation axis of the grip to generate on the grip an inertial force sufficient to move the grip from the rest position and to prevail on the contrast force of the elastic means.

7. The handle assembly according to claim 1, wherein the counter-weight has a greater mass than that of the grip, and the counter-weight is made of a metal alloy and the grip is made of a synthetic plastic material.

8. The handle assembly according to claim 1, wherein the counter-weight is shaped as a lever longitudinally extending in the direction of the longitudinal extension of the support and accommodated in the first position within a seat of the support, and the counter-weight hinged to the support parallel to the rotation axis of the grip at a first end thereof, opposite to a second end, arranged facing the mechanical motion transmission means and configured to intercept them in the second position.

9. A handle assembly according to claim 1, characterized in that wherein the counter-weight is shaped as a slide carried by the support so as to slide in a direction substantially perpendicular to the rotation axis of the grip within a seat arranged facing said mechanical motion transmission means.

10. A device, comprising:

a vehicle door handle assembly including:

a support configured to be fixed to a vehicle door;

a means for interfacing with a human hand and configured to move relative to the support upon application of at least one of a first force in a first direction to the means for interfacing, the means for interfacing with a human hand having a mass;

a means for transmitting the movement of the means for interfacing to a door lock so as to unlock the door upon application of the first force to the means for interfacing; and a means for preventing movement of the means for interfacing upon the application of a first acceleration to the means for interfacing in the first direction.

11. The device of claim 10, wherein:

the device is configured such that a second force is applied to the means for interfacing upon application of the first acceleration owing to the mass of the means for interfacing.

12. The device of claim 10, wherein:

the means for preventing movement of the means for interfacing includes a lever configured to contact the means for transmitting movement of the means for interfacing.

13. The device of claim 11, wherein:

the means for preventing movement of the means for interfacing includes a lever configured to contact the means for transmitting movement of the means for interfacing.

14. The device of claim 10, wherein:

the means for preventing movement of the means for interfacing includes a slidable counterweight configured to contact the means for transmitting movement of the means for interfacing.

15. The device of claim 11, wherein:

the means for preventing movement of the means for interfacing includes a slidable counterweight configured to contact the means for transmitting movement of the means for interfacing.

16. A device, comprising:

a vehicle door handle assembly including:

a support configured to be fixed to a vehicle door;

means for moving relative to the support upon a first force applied in a first direction to the means for moving relative to the support;

means for locking a vehicle door;

means for transmitting a movement of the means for moving relative to the support to the door locking means configured to unlock the door upon application of the first force or a first acceleration to the means for moving relative to the support; and means for preventing the release of the door locking means transversally movable to a rotation axis of the means for moving relative to the support upon the application of the first acceleration to the means for moving relative to the support in the first direction;

wherein the mass of the means for preventing the release of the door locking means is greater than the mass of the means for moving relative to the support, and the preventing means intercepts the transmitting means for stopping the movement thereof, thereby preventing the release of the door locking means.

17. The handle assembly according to claim 1, wherein the assembly is configured such that the counterweight remains at the first position in the absence of the acceleration to the handle and while the grip is at the working position.

18. The handle assembly according to claim 1, wherein the assembly is configured such that the grip can move from the rest position to the working position without moving the counterweight.

19. The handle assembly according to claim 1, wherein the counterweight is mechanically isolated from the grip in the absence of the acceleration to the handle.

20. A device, comprising:

a vehicle door handle assembly including:

a support configured to be fixed to the vehicle door;

means for moving relative to the support upon a first force applied in a first direction to the means for moving relative to the support;

means for transmitting a movement of the means for moving relative to the support to a door lock configured to unlock the door upon application of the first force or a first acceleration to the means for moving relative to the support; and means for preventing the release of the door lock transversally movable to a rotation axis of the means for moving relative to the support upon the application of the first acceleration to the means for moving relative to the support in the first direction;

wherein the mass of the means for preventing the release of the door lock is greater than the mass of the means for moving relative to the support, and the preventing means intercepts the transmitting means for stopping the movement thereof, thereby preventing the release of the door lock.

21. A handle assembly according to claim 1, wherein the counter-weight is configured to intercept the motion transmission means by (i) pivoting about a pivot axis of the counter-weight, wherein the assembly is configured to apply a moment to the counter-weight centered about the pivot axis of the counter-weight, or (ii) sliding linearly to intercept the motion transmission means.

22. A handle assembly according to claim 1, wherein the counter-weight is configured to move in a plane parallel to the rotation axis of the grip to intercept the motion transmission means.

23. A handle assembly according to claim 1, wherein the movement transmission means has a longitudinal axis at least substantially parallel to the rotation axis of the grip at a location where the motion transmission means is intercepted by the counter-weight.

24. A handle assembly according to claim 1, wherein the counter-weight is configured to extend about the motion transmission means to intercept the motion transmission means.

25. A handle assembly according to claim 1, wherein the counter-weight is configured to pivot about a pivot axis of the counter-weight, wherein the assembly is configured to apply a moment to the counter-weight centered about the pivot axis of the counter-weight.

* * * * *